US005108311A

United States Patent [19]

Nakazawa

[11] Patent Number: 5,108,311

[45] Date of Patent: Apr. 28, 1992

[54] SOCKET

[75] Inventor: Yasuo Nakazawa, Maebashi, Japan

[73] Assignee: Hosiden Corporation, Osaka, Japan

[21] Appl. No.: 763,560

[22] Filed: Sep. 23, 1991

[30] Foreign Application Priority Data

Sep. 27, 1990 [JP] Japan ..... 2-101471[U]

[51] Int. Cl.[5] ..... H01R 13/648

[52] U.S. Cl. ..... 439/607; 439/660; 439/677; 439/680

[58] Field of Search ..... 439/101, 108, 607, 608, 439/660, 677, 678, 680, 681

[56] References Cited

U.S. PATENT DOCUMENTS

| | | | |
|---|---|---|---|
| 4,500,159 | 2/1985 | Briones et al. | 439/607 |
| 4,611,878 | 9/1986 | Hall et al. | 439/680 X |
| 4,643,509 | 2/1987 | Hollyday et al. | 439/607 |
| 4,983,127 | 1/1991 | Kawai et al. | 439/607 X |

*Primary Examiner*—Neil Abrams
*Assistant Examiner*—Khiem Nguyen
*Attorney, Agent, or Firm*—Pollock, VandeSande and Priddy

[57] ABSTRACT

A columnar key is formed integrally with a socket body of an insulating material attached to the back of a cylindrical metal member of a socket and extends in the cylindrical member axially thereof. The socket body had contact support plates extending axially therefromm in the cylindrical member so that they extend over and under the columnar key, respectively. The cylindrical member has a plug guide portion for guiding a cylindrical metal shield cover of the mating plug to the position where the front end face of the plug body abuts against the front end face of the columnar key while holding the center axis of the shield cover of the plug in alignment with the center axis of the cylindrical member of the socket after the cylindrical metal shield cover of the plug is inserted into the cylindrical member of the socket. By turning the plug about its axis to a specified rotational angular position after the front end face of the plug body abuts against the front end face of the columnar key, the columnar key is fitted into a key hole made in the plug body, permitting further insertion of the plug into the socket.

7 Claims, 8 Drawing Sheets

SOCKET

BACKGROUND OF THE INVENTION

The present invention relates to a socket which permits easy positioning of a plug relative thereto.

FIGS. 1 and 2 show a conventional socket, in which a hollow cylindrical member of metal 10 is received in an annular groove cut in the front of a socket body 11 of an insulating material and contacts 14 are housed in a columnar portion 13 of the body 11 surrounded by the cylindrical member 10. The columnar portion 13 has cut in its peripheral surface positioning grooves 15*a*, 15*b* and 15*c* extending lengthwise thereof. FIG. 3 shows the mating plug to be put in the socket, in which a plug body 16 supports contacts 17 projecting out therefrom and is fixedly held in a hollow cylindrical member of metal 18 surrounding the contacts 17. The cylindrical member 18 has inward protrusions 19*a*, 19*b* and 19*c* (19*c* not shown) in its forward portion.

The plug can be put in the socket only when the former has been turned to the position where its protrusions 19*a*, 19*b* and 19*c* are aligned with the corresponding positioning grooves 15*a*, 15*b* and 15*c* of the socket, respectively. The forward portion of the cylindrical member 18 of the plug is fitted into the annular groove 12 inside the cylindrical member 10 of the socket, by which the corresponding contacts 14 and 17 of the socket and the plug are brought into engagement with each other.

For example, in the case where the socket happens to be mounted on the back of a device used therewith and hence cannot be seen directly when the plug is put therein, it is necessary to bring the protrusions 19*a*, 19*b* and 19*c* of the plug into alignment with the positioning grooves 15*a*, 15*b* and 15*c* of the socket by blindly turning the plug about its axis while at the same time urging its forward end against the front of the socket. It is difficult, however, to align the axes of the plug and the socket and to turn the plug for rotational angular positioning relative to the socket without causing misalignment therebetween, and consequently, it is hard and time-consuming to put the plug in the socket. In addition, since the plug is turned while being pressed against the socket, the protrusions 19*a*, 19*b* and 19*c* of the plug abrade the peripheral surface of the columnar portion 13 of the resin-made body 11 and powder may sometimes adhere to the contacts, causing bad contact therebetween.

SUMMARY OF THE INVENTION

It is therefore an object of the present invention to provide a socket which enables the mating plug to be turned to a predetermined rotational angular position with ease, even if the socket cannot be seen.

In the socket of the present invention there is provided, inside a cylindrical metal member surrounding an array of contacts held by a contact holder of an insulating material, a columnar key which extends from the contact holder axially thereof and forwardly beyond the tips of the contacts. The cylindrical metal member includes a plug guide portion which guides cylindrical shield cover of the mating plug to bring the front end face of its insulating body into abutment against the tip of the columnar key of the socket while holding the cylindrical shield cover of the plug substantially in axial alignment with the cylindrical metal member of the socket, and a cylindrical shield cover receiving portion into which the cylindrical shield cover of the plug is inserted after being fitted into the columnar key of the socket by turning the plug at the position where the insulating body of the plug abuts against the columnar key of the socket.

DESCRIPTION OF THE PREFERRED EMBODIMENTS

Figure 5:
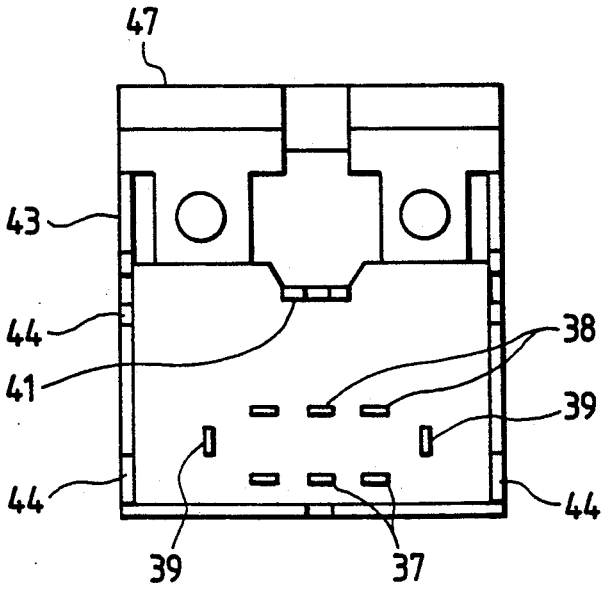
FIG. 5 is a bottom view of the socket shown in FIG. 4.
Figure 6:
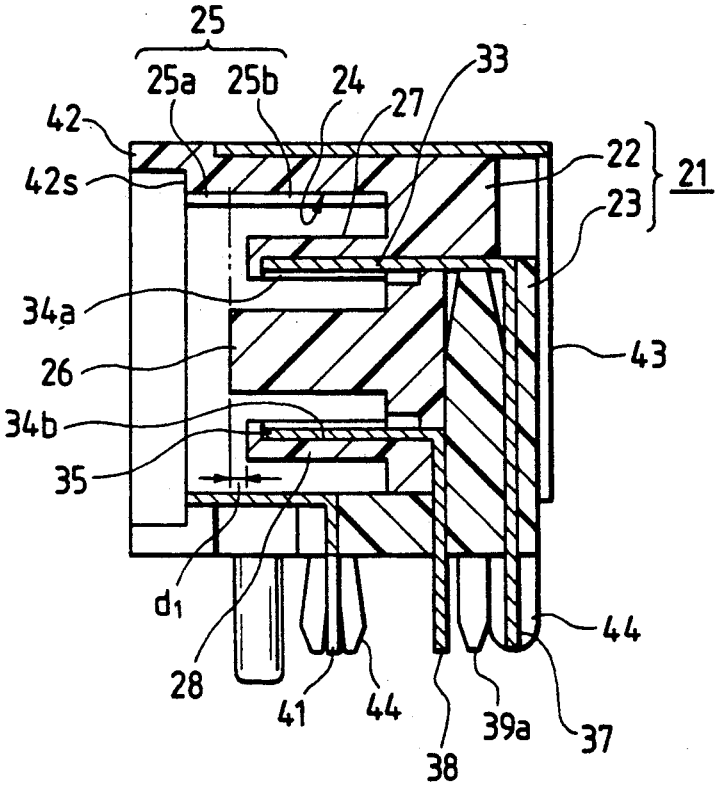
FIG. 6 is a sectional view taken on the line VI—VI in FIG. 4.

FIGS. 4 through 7 illustrates an embodiment of the socket according to the present invention. A body 21 of an insulating material has a rectangular parallelpipedic configuration and includes a contact holding portion 22 and a terminal lead portion 23 for external connection of contact terminals as shown in FIG. 6. The terminal lead portion 23 is L-shaped and has its vertical portion abutted on the back of the contact holding portion 22 and its horizontal portion abutted on the bottom of the contact holding portion 22.

The body 21 has in its front a circular hole 24, in which a cylindrical metal member 25 is held in contact with its interior surface. A columnar key 26, substantially rectangular in section and formed integrally with the body 21, extends forwardly thereof from the bottom of the circular hole 24 centrally thereof. The columnar key 26 has its two adjacent corners rounded so that it can be inserted into a key hole of an insulating body of the mating plug at only one rotational angular position. If the columnar key 26 is not at a specified rotational angular position relative to the key hole of the mating plug put in the socket, then the front end face of the columnar key 26 abuts against the front end face of the insulating body of the mating plug, preventing it from further insertion into the socket. The contact holder 22 has formed integrally therewith contact support plates 27 and 28 opposite the top and bottom of the columnar key 26, respectively.

The columnar key 26 has two parallel slots extending axially from its front end face on both sides of a partition wall 29. The lower contact support plate 28 has edge flanges 28*a* and 28*b* raised from its both sides substantially along the inner wall of the circular hole 24 in spaced relation thereto to a position slightly higher than the plane containing the bottom of the columnar key 26. The upper contact support plate 27 is substantially flat and its both sides extend along the inner surface of the circular hole 24 in spaced relation thereto. In the top of the upper contact support plate 27 and the bottom of the lower contact support plate 28 there are cut two guide grooves 31 and 32, respectively, which extend lengthwise thereof.

Figure 7:
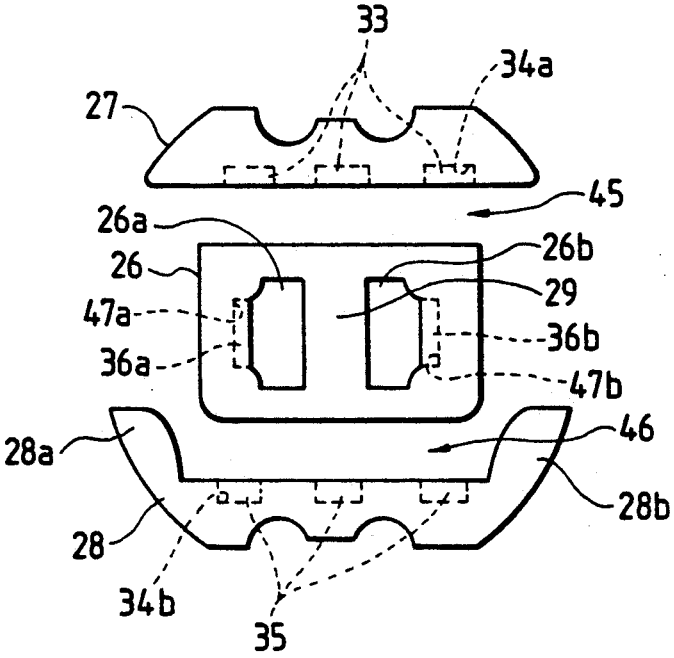
FIG. 7 shows, on an enlarged scale, the front end faces of a columnar key 26 and contact support plates 27 and 28.

The contact support plates 27 and 28 have cut therein three axially extending contact housing grooves 34*a* and 34*b* opposite the columnar key 26, in which there are housed three signal contacts 33 and 35 as depicted in FIGS. 6 and 7. The tips of the contact support plates 27 and 28 project out forwardly of the tips of the signal contacts 33 and 35. In the case where the mating plug has been turned about 180 degrees from its correct rotational angular position, the front end faces of the edge flanges 28*a* and 28*b* of the contact support plate 28 stand adjacent the front end face of the plug, and if the plug is forced into the socket, then the confronting end faces abut against each other, blocking the forced insertion of the plug.

In left and right inner walls of the slots 26*a* and 26*b* made in the columnar key 26, as shown in FIG. 7, there are cut contact housing grooves 47*a* and 47*b* extending axially thereof, in which power supply contacts 36*a* and 36*b* are housed and supported. As depicted in FIGS. 5 and 6, rear end portions of the signal contacts 33 and 35 and the power supply contacts 36*a* and 36*b* are bent downward so that they extend through the terminal lead portion 23 and project out of the bottom of the body 21 as terminals 37, 38, 39*a* and 39*b*, respectively. The cylindrical member 25 also has its terminal 41 projected out of the bottom of the terminal lead portion 23.

To prevent that the front end portions of the contact support plates 27 and 28 are abraded by the front end edge of a cylindrical metal shield cover of a mating plug during the rotational angular positioning of the mating plug relative to the socket, the front end face of the columnar key 26 protrudes forward more than the front end faces of the contact support plates 27 and 28 by $d_1$. The front marginal portion of the cylindrical metal member 25 protrudes further than the front end face of the columnar key 26 to define a plug guide portion 25*a*, by which the cylindrical shield cover of the mating plug fitted thereinto is guided, with the axis of the shield cover aligned with the axis of the cylindrical member 25, until the front end face of the insulating body of the plug comes into abutment with the front end face of the columnar key 26. The rear of the plug guide portion 25*a* of the cylindrical metal member 25 defines a shield cover receiving portion 25*b* into which the cylindrical shield cover of the plug is inserted further after the columnar key 26 engages with the plug.

The front marginal portion of the body 21 projects further than the front marginal edge of the cylindrical metallic member 25 to form a sleeve 42 coaxial with the circular hole 24. The inside diameter of the sleeve 42 is larger than the inside diameter of the circular hole 24 to allow ease in putting the mating plug therein. The front edge of the cylindrical member 25 is flush with a stepped portion 42*s* formed between the inner wall surfaces of the circular hole 24 and the sleeve 42 or projects a little forwardly thereof so that the front marginal edge of the metal shield cover of the mating plug does not abrade the inner marginal edge of the stepped portion 42*s*.

The body 21 is covered with a metal cover 43, except its front and bottom. A terminal 44 of the cover 43 projects out downward from the bottom of the body 21. The columnar key 26 and the contact support plates 27 and 28 define therebetween partition wall receiving grooves 45 and 46, into which partition walls forming a square-sectioned wall of the mating plug are inserted, with the columnar key 26 aligned with the key hole of the plug.

Figure 10:
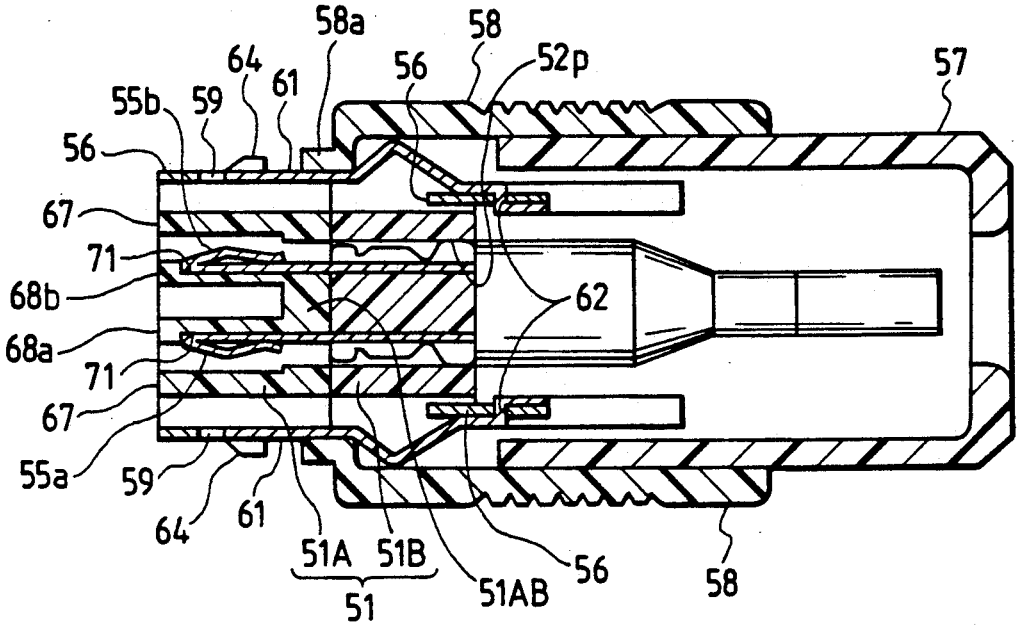
FIG. 10 is a sectional view taken on the line X—X in FIG. 8.
Figure 11:
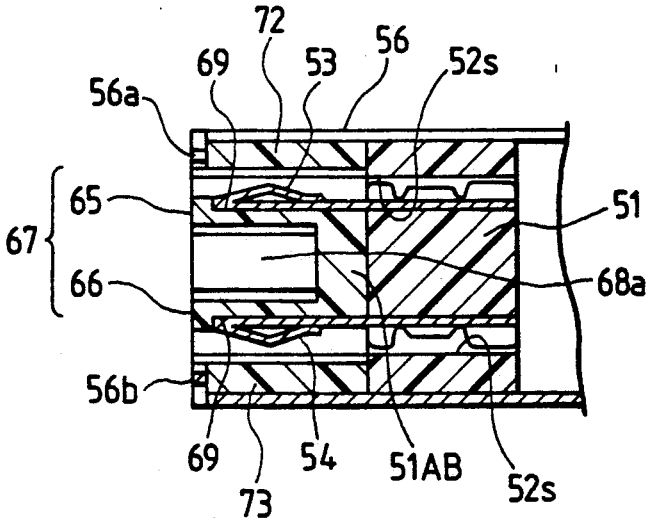
FIG. 11 is a radial sectional view taken on the line XI—XI in FIG. 8.

FIG. 8 through 11 illustrate an embodiment of the plug according to the present invention. As shown in FIGS. 10 and 11, a substantially columnar body 51 of an insulating material in this example is composed of separate front and rear half portions 51A and 51B, which are coupled in tandem at a predetermined rotational angular position relative to each other by coupling means not shown. The front half portion 51A of the body 51 includes a rear end wall 51AB, a substantially rectangular-sectioned tubular wall 67 extending forwardly from the front of the rear end wall 51AB substantially centrally thereof, guide plates 72 and 73 which extend forwardly from the rear end wall 51AB and are opposite at one side to upper and lower partition walls 65 and 66 each forming part of the rectangular-sectioned tubular wall 67 and each form at the other side a part of the outer peripheral surface of the columnar body 51. Flat support arms 68*a* and 68*b* are extending forwardly from the rear end wall 51AB in parallel but spaced relation to each other inside the rectangular-sectioned tubular wall 67. The hole inside the rectangular-sectioned tubular wall 67 is substantially rectangular and its two adjacent corners are rounded to define a key hole 64*k* for receiving the columnar key 26 of the socket.

There are bored through the rear body half portion 51B and the rear end wall 51AB two upper and lower rows of three contact housing holes 52*s* (see FIG. 11), which are contiguous to contact housing grooves 69 flush with them and cut in the outer faces of the upper and lower partition walls 65 and 66. Three signal contacts 53 and three signal contacts 54 are received in and extended through both the contact housing holes 52*s* and the contact housing grooves 69. Similarly, there are bored through the rear body half portion 51B and the rear end wall 51AB two contact housing grooves 52*p*, which are contiguous to contact housing grooves 71 cut in the outer surfaces of the flat support arms 68*a* and 68*b*. Two power supply contacts 55*a* and 55*b* are received in and extended through both the contact housing holes 52 and the contact housing grooves 71. The contacts 53, 54, 55*a* and 55*b* have their forward end portions folded back to form contact portions protruding from the grooves 69 and 71.

The body 51 is fixedly received in a cylindrical shield cover 56, with the front end faces of the rectangular-sectioned tubular wall 67 and the support arm 68*a* and 68*b* held in line with the front edge of the cylindrical shield cover 56. The front end faces of the guide plates 72 and 73 are a little behind the front end face of the rectangular-sectioned tubular wall 67, and protective bars 56*a* formed by partially cutting and bending the front marginal edge of the shield cover 56 are provide in front of the front end faces of the guide plates 42 and 73. The rear half portion of the shield cover 56 is fixedly received in a cylindrical cap 57 of an insulating material. A cylindrical coupling 58 of an insulating material is put on the cap 57. The coupling 58 has its front marginal portion reduced in its inner diameter to form a small-diametered portion 58*a* which is slidable on the shield cover 56 in its axial direction.

The shield cover 56 has cut therein two axially elongated holes 59 at diametrically opposite positions. An elastic lever 61 has its free forward end portion disposed in each elongated hole 56 and its read end portion engaged with a slit 62 made in the shield cover 56 near its rear end. The intermediate portion of the lever 61 is bent outwardly in a triangular form and protrudes toward the interior surface of the coupling 58 in front of the front edge of the cap 57, and the lever 61 has a pair of lugs 64 which protrude from its forward end in front of the small-diametered portion 58*a* of the cylindrical shield cover 58 radially outwardly thereof. When the plug is put in the socket of FIGS. 4–7, the lugs 64 engage holes (not shown) made in the side wall of the cylindrical member 25 of the socket, thus locking the plug to the socket. The plug can be unlocked from the socket simply by pulling the coupling 58 backward. That is, when the coupling 58 is pulled back, the small-diametered portion 58*a* of the cylindrical shield cover 58 urges the triangularly-bent portion of each lever 61 inwardly, and consequently, the lugs 64 are also displaced inwardly and disengaged from the above-mentioned holes, thus unlocking the plug from the socket.

The upper and lower partition walls 65 and 66 of the rectangular-sectioned tubular wall 67 separate the signal contacts 53, 54 and the power supply contacts 55*a*, 55*b* and these walls are fitted into grooves 45 and 46 of the socket. The partition wall 66 protrudes from the rectangular-sectioned tubular wall 67 on both sides thereof to the inner wall surface of the shield cover 56. As shown in FIG. 11, the fold edges of the signal contacts 53 and 54 are held against forward end faces of the contact housing grooves 69 made in the partition walls 65 and 66 in the axial direction thereof, and hence they are mechanically protected when the partition walls 65 and 66 are inserted into the slots 26*a* and 26*b* of the socket. The contact portions of the signal contacts 53 and 54 protrude from the grooves 69 as mentioned previously, so that they can readily come into contact with the mating contacts 33 and 34 when the plug is put in the socket. The power supply contacts 55*a* and 55*b* are also protected by the support arms 68*a* and 68*b*, respectively, and their contact portions make contact with the power supply contacts 36*a* and 36*b* of the socket.

To ensure positioning and coupling of the plug to the socket, the guide plates 72 and 73 of an insulating material are disposed in adjacent but spaced relation to the partition walls 65 and 66, respectively. The guide plates 72 and 73 have, on the inside thereof, axially elongated protrusions 74 and 75 formed integrally therewith. The outer peripheral surface of each of the guide plates 72 and 73 is held in contact with the interior surface of the shield cover 56. The forward end faces of the rectangular-sectioned tubular wall 67, the support arms 68*a*, 68*b* and the shield cover 56 are positioned in about the same plane. The rectangular-sectioned tubular wall 67, the support arms 68*a*, 68*b* and the guide plates 72, 73 are formed as a unitary structure with the rear end wall 51AB of the front half portion 51A of the body 51, and this structure is attached to the front of the rear half portion 51B of the body 51 in an abutment manner. The front half portion 51A and the rear half portion 51B of the body 51 may also be formed as a unitary structure.

Figure 12:
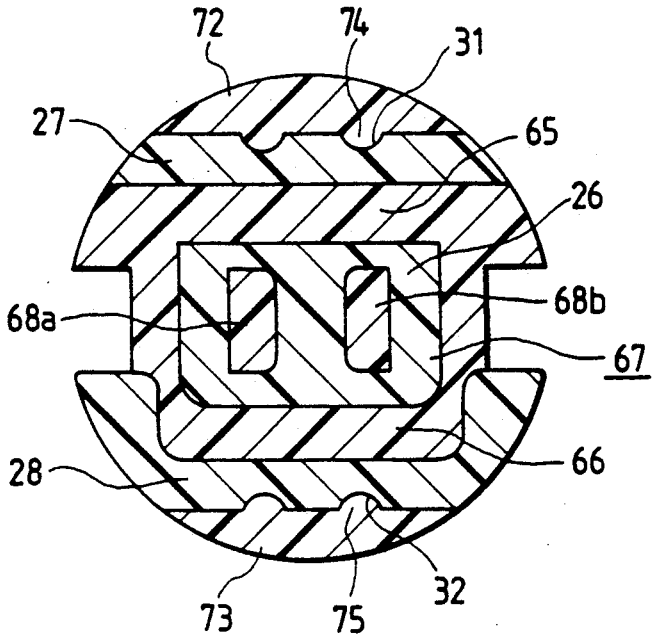
FIG. 12 is a sectional view showing the connection of the socket of FIG. 4 and the plug of FIG. 8.

In the case of putting the plug in the socket, when the tip end portion of the shield cover 56 of the plug is inserted into the sleeve 42 of the socket and a part of the marginal edge of the shield cover 56 abuts against the stepped portion 42*s*, the other remaining part of the marginal edge of the shield cover 56, which does not abut against the stepped portion 42*s*, slightly enters into the cylindrical member 25 of the socket, and consequently, the center axis of the plug is slightly inclined with respect to the center axis of the socket. As a result of this, the force applied to the plug acts to slide the shield cover 56 in a direction in which to bring the center axis of the plug toward the center axis of the socket, facilitating entrance of the tip end portion of the shield cover 56 into the cylindrical member 25 of the socket. As the plug is further pressed into the socket, the center axis of the shield cover 56 naturally gets into alignment with the center axis of the cylindrical member 25, and as described previously, the front end face of the rectangular-sectioned tubular wall 67 abuts against the front end face of the columnar key 26 of the socket. Then, the plug is turned to a certain rotational angular position, where the columnar key 26 is fitted into the key hole 67*k* inside of the rectangular-sectioned tubular wall 67, so that the plug can be further pressed into the socket. After the shield cover 56 is thus fitted into the cylindrical member 25, the columnar key 26 is received in the rectangular-sectioned tubular wall 56, the support arms 68*a* and 68*b* are received in the slots 26*a* and 26*b*, the contact support plate 28 is held between the partition wall 65 and the guide plate 72, the contact support plate 28 is held between the partition wall 66 and the guide plate 73, and the elongated protrusions 74 and 75 are received in the guide grooves 32 and 31, as depicted in FIG. 12. The respective dimensions of the socket and plug are chosen accordingly. When the plug and the socket are thus coupled, the signal contacts 33, 35 of the latter and the signal contacts 53 and 54 of the former are in contact with each other, and the power supply contacts 36*a*, 36*b* of the latter and the power supply contacts 55*a*, 55*b* of the former are in contact with each other.

Figure 13:
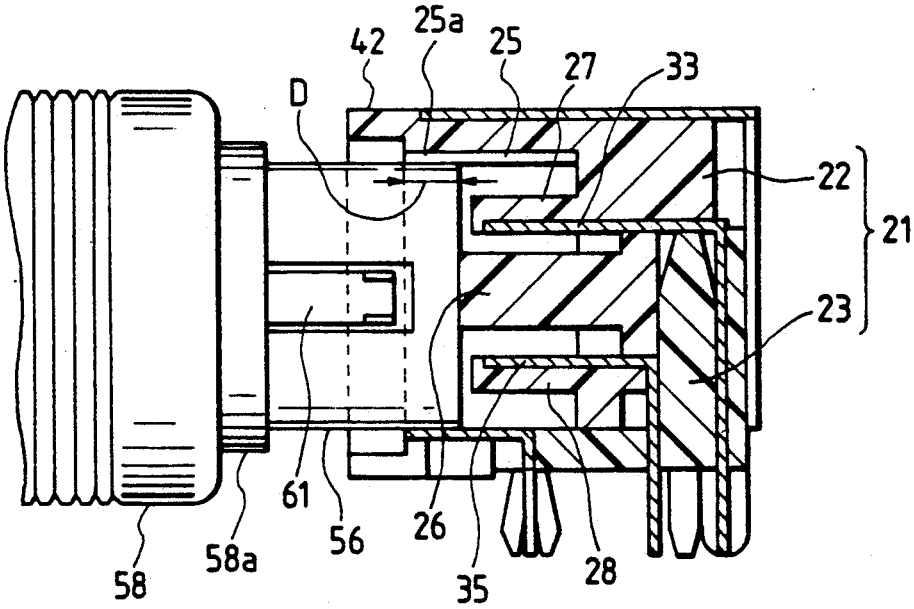
FIG. 13 is a side view illustrating the state of insertion of the forward end portion of the plug in a plug guide portion of the socket shown in section.

In the case of putting the plug in the socket, the plug can easily be brought to a specified rotational angular position by turning it about its axis, with the shield cover 56 of the plug received in the cylindrical member 25 of the socket as shown in FIG. 13. In addition, the front marginal edge of the shield cover 56 does not abrade any insulating material portions of the socket during the rotational angular positioning.

Figure 8:
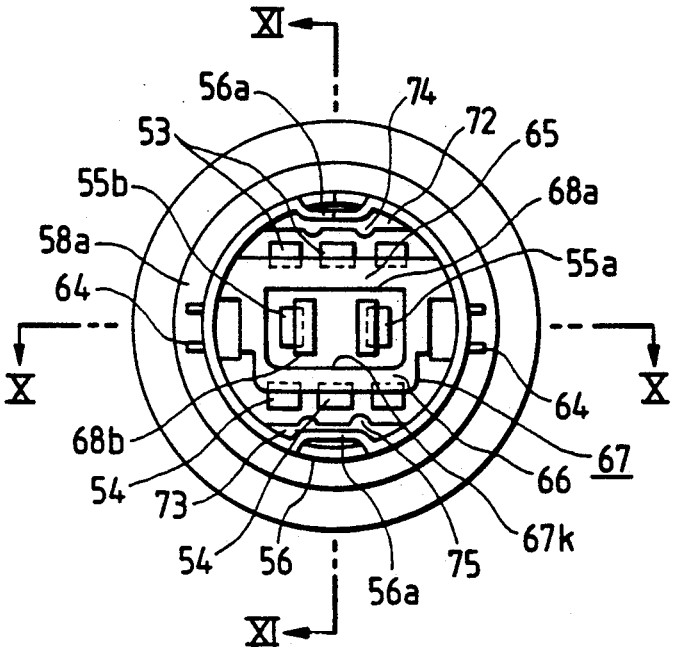
FIG. 8 is a front view illustrating an example of a plug which can be fitted in the socket of FIG. 4.
Figure 9:
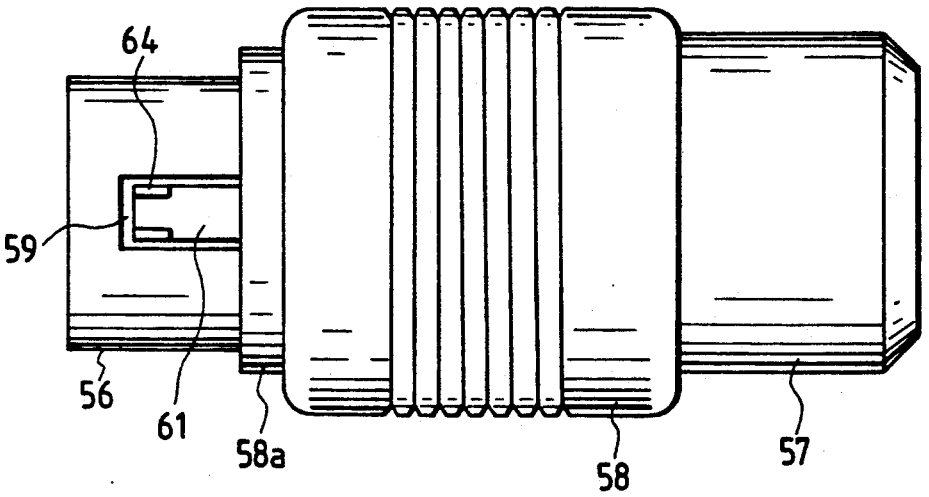
FIG. 9 is a right side view of the plug depicted in FIG. 8.
Figure 14:
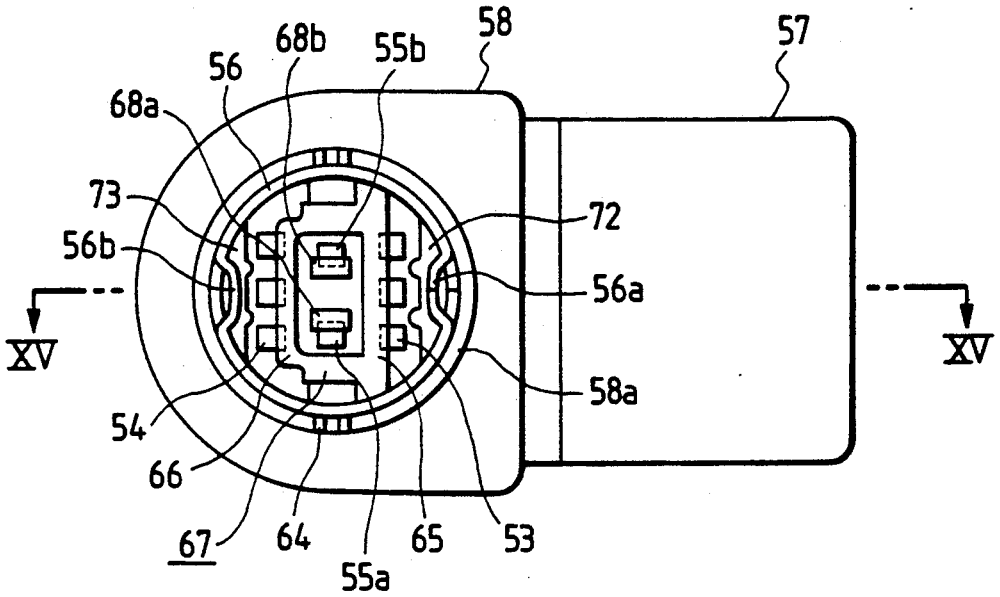
FIG. 14 is a front view illustrating another example of the plug.
Figure 15:
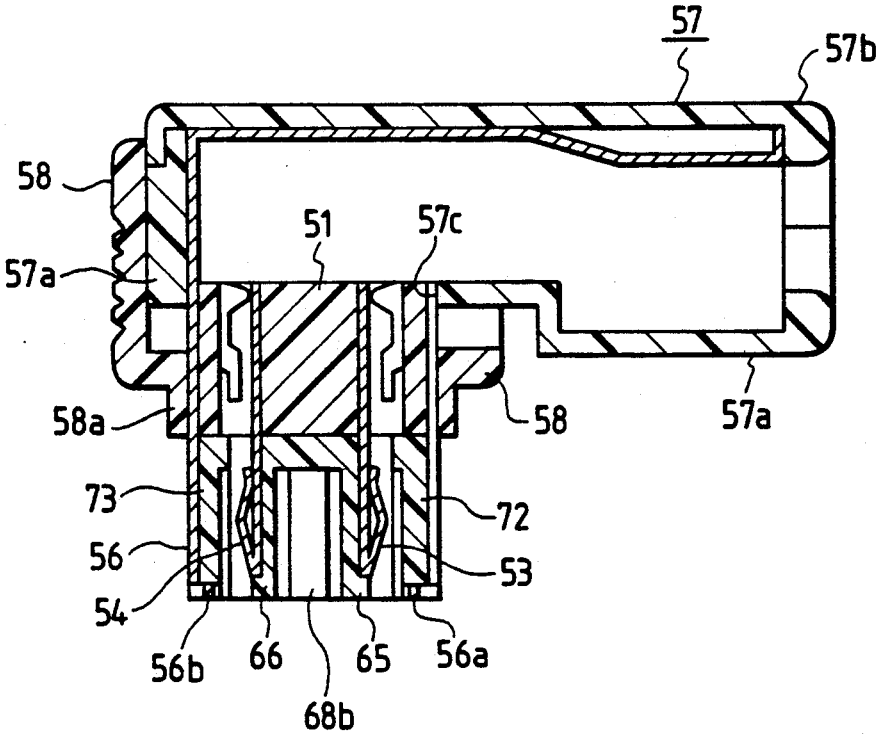
FIG. 15 is a sectional view taken on the line XVI—XVI in FIG. 14.

In the above example the plug is put in and pulled out of the socket in the axial direction of the cap 57 and a cable having conductor wires (not shown) connected to the contacts is led out of the rear end face of the cap 57, but the plug may also be constructed so that a cap 57 substantially rectangular parallelpipedic in shape extends from the plug body at right angles to its axis, as depicted in FIGS. 14 and 15 in which the parts corresponding to those in FIGS. 8 and 11 are identified by the same reference numerals. In this instance, the non-extended side of the cap 57 is semicylindrical. A circular hole 57*c* coaxial with the semicylindrical face is made in the front end portion of the cap 81 and the rear end portion of the cylindrical member 56 is received in the circular hole 57*c*. The inside of the cylindrical member 56 is formed to have the same construction as that of the plug described above, and a coupling 58 having a small-diametered portion 58*a* through which the cylindrical member 56 is inserted, is mounted to cover the semicylindrical portion of the cap 57. The cap 57 is composed of a case portion 57*a* from which the cylindrical member 56 projects and a lid portion 57*b* for covering the case portion 57*a*. A cable (not shown) is led out through a hole made in the end face of the cap 57 on the opposite side from its cylindrical end face.

The levers 61 are locking the plug to the socket. When the cylindrical member 56 of the plug is inserted into the cylindrical member 25 of the socket to a predetermined position, the lugs 64 are engaged with small holes (not shown) made in the cylindrical member 25, by which the plug is prevented from being pulled out of the socket. The plug can be unlocked from the socket by pulling the coupling 58 backward. As in the above-described embodiment, the front marginal portion 58*a* of the coupling 58 is reduced in diameter to form the small-diameterd portion 58*a* serving as an engaging ring. The inner peripheral surface of the ring 58*a* is substantially in contact with the outer peripheral surface of the cylindrical member 56, and the triangular bent portions of the levers 61 are positioned in the large-diametered portion of the coupling 58 behind the ring 58*a*. Accordingly, when the coupling 58 is pulled back, the triangular bent portions of the levers 61 are displaced inwardly by the rear edge of the ring 58*a* and the lugs 64 are disengaged from the small holes in the cylindrical member 25 of the socket, thus unlocking the plug from the socket.

Figure 16:
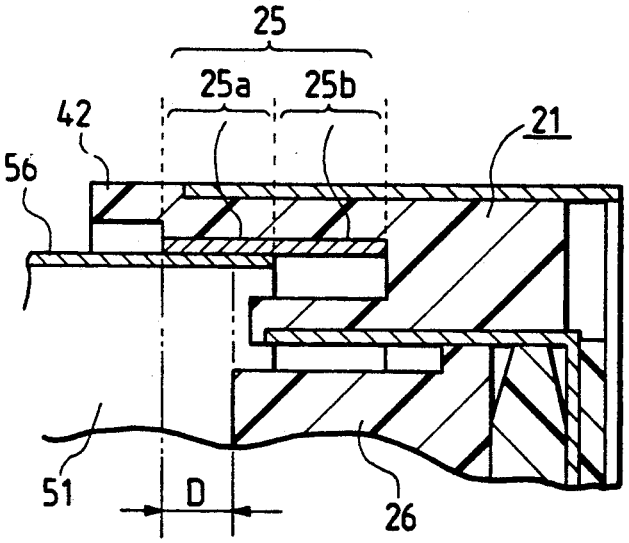
FIG. 16 partially shows, in section, the socket and the plug for explaining a modified form of the present invention.

In the above embodiment, since the front end face of the body 51, in particular, the front end face of the rectangular-sectioned tubular wall 67 is in line with the front marginal edge of the shield cover 56 of the plug, the plug guide portion 25*a* of the cylindrical member 25 of the socket is defined by a portion of a length D forwardly of the front end face of the columnar key 26 as shown in FIG. 13. As party shown in FIG. 16, however, when the front marginal edge of the shield cover 56 of the plug protrudes more than the front end face of the body 51, the front marginal edge of the shield cover 56 enters deeply into the cylindrical member 25 in excess of the length D until the front end face of the columnar key 26 abuts against the front end face of the plug body 51, and accordingly, the plug guide portion 25*a* of the cylindrical member 25 is longer than the length D.

As described above, according to the present invention, since the plug guide portion 25*a* is provided in the forward portion of the cylindrical member 25 of the socket for allowing free insertion of the shield cover 56 of the plug into the cylindrical member 25, with the axis of the shield cover 56 held in aligned with the axis of the socket, until the front end face of the columnar key 26 of the socket abuts against the front end face of the plug body, the plug can be turned about its axis to a specified angular position, with the end portion of the plug held in the plug guide portion 25*a*, as described previously in respect of FIG. 13. In this case, the center axis of the plug is held at the center of the cylindrical member 25 by the plug guide portion 25*a*, and consequently, the rotational angular positioning of the plug can easily be done, even if the socket cannot be seen directly. Moreover, the front marginal edge of the shield cover 56 of the plug will not abrade the socket body 21 in such positioning of the plug relative to the socket.

With the structure of the present invention, the number of plug turning operations and/or the rotational angular range for positioning can be reduced. Hence, abrasive wear of the front of the socket body (i.e. the front end face of the columnar key) decreases—this removes the possibility of the damaging the socket body accordingly.

Since the front end face of the columnar key 26 slightly protrudes as compared with the front end faces of the support arms 27 and 28 as described previously, the plug will not come into contact with the support arms 27 and 28 and hence will not damage them during the rotational angular positioning of the plug.

If the sleeve 42, which has an inner diameter greater than the outer diameter of the cylindrical member 25 and is coaxial therewith, is extended from the front marginal edge of the socket body forwardly of the plug guide portion 25*a*, then the tip end of the shield cover of the plug can be blindly inserted into the sleeve 42 with ease, and consequently, the shield cover can be inserted more easily into the plug guide portion 25*a*.

Figure 1:
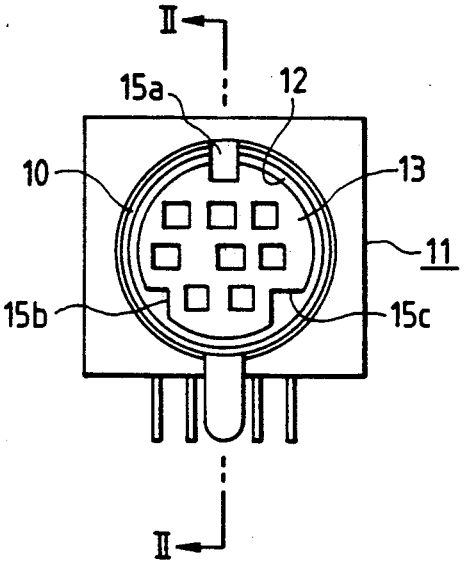
FIG. 1 PRIOR ART
FIG. 1 is a front view of a conventional socket.
Figure 2:
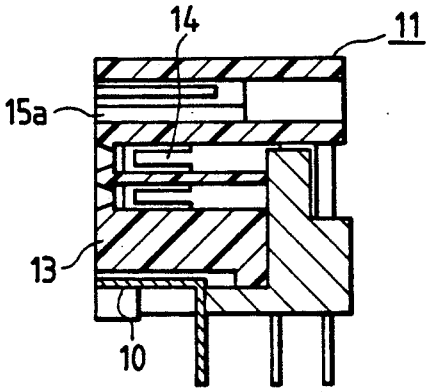
FIG. 2 PRIOR ART
FIG. 2 is a sectional view taken on the line II—II in FIG. 2.
Figure 3:
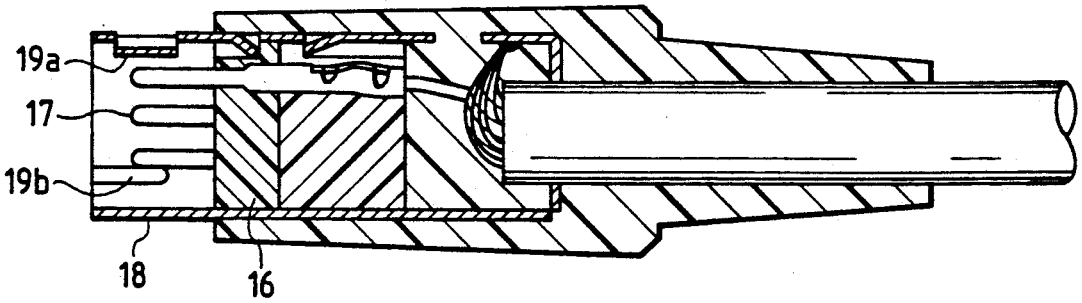
FIG. 3 PRIOR ART
FIG. 3 is a sectional view of a plug which is put in the socket depicted in FIG. 1.
Figure 4:
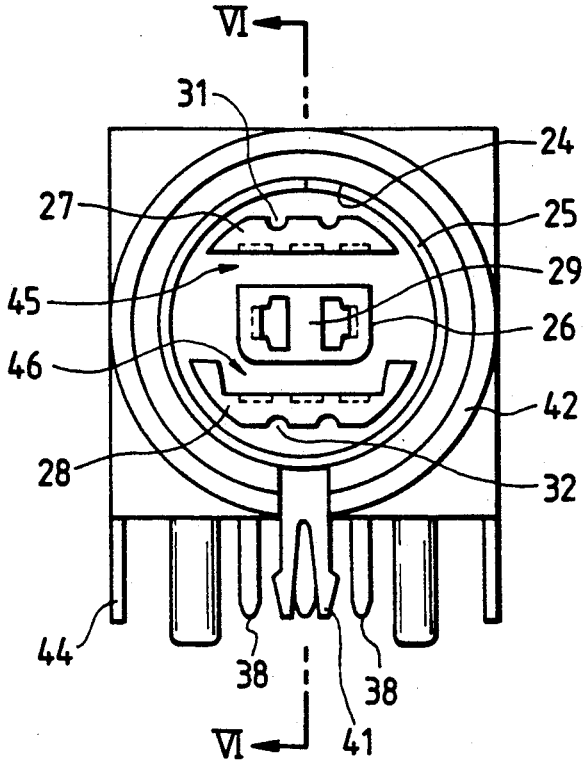
FIG. 4 is a front view illustrating an example of the socket according to the present invention.

The plug guide portion may also be defined in the forward portion of the cylindrical member 10 by using the plug shown in FIG. 3 and by constructing the socket so that the front end face of the columnar portion 13 of the socket depicted in FIGS. 1 and 2 is rearwardly of the front marginal edge of the cylindrical member 10.

It will be apparent that many modifications and variations may be effected without departing from the scope of the novel concepts of the present invention.

What is claimed is:

1. A socket in which is put the mating plug having a cylindrical shield cover of metal and an insulating plug body holding a plurality of contacts inside said cylindrical member, said socket comprising:

a plurality of contacts disposed in parallel and extending in the same axial direction;

a contact holding portion of an insulating material, for holding said plurality of contacts;

a cylindrical member of metal having its center axis in said axial direction and surrounding said plurality of contacts; and a columnar key formed integrally with said contact holding portion, extending in said axial direction inside said cylindrical member and having its front end face protruding forwardly more than the tips of said plurality of contacts;

wherein said columnar key is shaped so that, only at a rotational angular position about said center axis, it is fitted into a key hole made in an insulating body of said mating plug and extending rearwardly from its front end face and that, at other rotational angular positions, it abuts against the front end face of said insulating body of said mating plug, preventing its further insertion; and wherein said cylindrical member has an inner diameter slightly greater than the outer diameter of said cylindrical shield cover of said mating plug and includes: a plug guide portion for guiding said cylindrical cover, when inserted into said cylindrical member, to a position where the tip of said columnar key abuts against the front end face of said insulating plug body, while at the same time holding the center axis of said cylindrical shield cover of said mating plug substantially in alignment with the center axis of said cylindrical member of said socket; and a shield cover receiving portion into which said cylindrical shield cover of said mating plug is further inserted after said columnar key is turned relative to said mating plug at said abutting position and is then inserted into said key hole of said mating plug, said plug guide portion and said shield cover receiving portion being contiguous and having the same diameter.

2. The socket of claim 1, wherein said contact holder portion is formed integrally with a socket body of an insulating material which surrounds the outer periphery of said cylindrical member and closing its rear end and said socket body has a sleeve protruding forwardly of the front marginal edge of said cylindrical member so that it defines an opening concentric with said cylindrical member and having an inner diameter greater than the outer diameter of the latter.

3. The socket of claim 1 or 2, wherein said plurality of contacts include at least one first strip-like contact disposed between said columnar key and the inner wall of said cylindrical member, and said contact holder portion includes a first support plate extending forwardly in said axial direction along one side of said first strip-like contact and having its front end face intermediate between the tip of said first strip-like contact and the front end face of said columnar key in said axial direction.

4. The socket of claim 3, wherein said plurality of contacts include at least one second strip-like contact disposed between said columnar key and the inner wall of said cylindrical member on the opposite side from said first strip-like contact with respect to said columnar key, and said contact holder portion includes a second support plate extending in said axial direction along one side of said second strip-like contact and having its front end face intermediate between the tip of said second strip-like contact and the front end face of said columnar key in said axial direction.

5. The socket of claim 4, wherein said first and second support plates have cut in one side thereof contact housing grooves extending in said axial direction for housing said first and second strip-like contacts with their other sides exposed, respectively.

6. The socket of claim 5, wherein said first and second support plates have their other sides disposed opposite the inner wall surface of said cylindrical member in spaced relation.

7. The socket of claim 1 or 2, wherein said columnar key has at least one slot-like contact housing hole bored therethrough rearwardly from its front end face in said axial direction, and said plurality of contacts include a strip-like contact disposed along the inner wall of said contact housing hole at one inner side thereof.

* * * * *